US007798230B2

(12) United States Patent
Booth

(10) Patent No.: US 7,798,230 B2
(45) Date of Patent: Sep. 21, 2010

(54) DOWNHOLE TOOL

(75) Inventor: Richard Keith Booth, Onchan (IM)

(73) Assignee: Hamdeen Incorporated Limited, Onchan (IM)

( * ) Notice: Subject to any disclaimer, the term of this patent is extended or adjusted under 35 U.S.C. 154(b) by 47 days.

(21) Appl. No.: 12/154,725

(22) Filed: May 27, 2008

(65) Prior Publication Data

US 2009/0044939 A1 Feb. 19, 2009

(51) Int. Cl.
*E21B 34/06* (2006.01)

(52) U.S. Cl. ..... 166/334.4; 166/332.1; 166/334.1; 166/323

(58) Field of Classification Search ..... 166/334.4, 166/332.1, 334.1, 323
See application file for complete search history.

(56) References Cited

U.S. PATENT DOCUMENTS 2,663,307 A * 12/1953 Birdwell ..... 166/184
3,970,147 A * 7/1976 Jessup et al. ..... 166/374
6,263,969 B1 * 7/2001 Stoesz et al. ..... 166/334.4
7,040,395 B2 5/2006 Booth

FOREIGN PATENT DOCUMENTS

GB 2272923 A 6/1994
GB 2342666 A 4/2000
GB 2365889 A 2/2002

* cited by examiner

*Primary Examiner*—Giovanna C Wright
(74) *Attorney, Agent, or Firm*—Drinker Biddle & Reath LLP

(57) ABSTRACT

A downhole tool for use within a well has a body with a first downhole fluid passage provided in the body. The first downhole fluid passage has an upper inlet and a lower outlet. A first sleeve member is slidably mounted to the body such that the first sleeve member is movable between a first position in which the first sleeve member extends from the body and a second position in which the first sleeve member is substantially retracted into the first downhole fluid passage of the body. A guide adapted to guide an object travelling within the first downhole fluid passage to the first sleeve member is provided.

24 Claims, 2 Drawing Sheets

DOWNHOLE TOOL

The present invention relates to downhole tools. In particular, the invention relates to downhole tools which can be inserted into a well bore for carrying out cleaning of the well bore casing.

BACKGROUND

During oil and gas extraction, the well is typically lined using casing which comprises a number of steel pipes, typically each having a length of around ten meters, which are connected together as they are run into the well then cemented in place. Prior to completion of the well, fluid is typically circulated to remove debris from the well. The drilling fluid is pumped down the internal bore of the drill string to the bit and returns in the annulus between the drill string and the well casing. However, this cleaning process can be inefficient for a number of reasons.

Step changes in the internal diameter of the borehole and casing can reduce the flow rate of the cleaning fluid. It is desirable to be able to direct cleaning fluid, preferably at a higher rate, at particular vertical sections of the casing. It is known to provide tools connected within the drill string which can selectively redirect fluid through transverse ports provided at the tools.

These known tools are typically moveable between an extended position in which the transverse ports are closed and a collapsed position in which the transverse ports are open. A mandrel of the tool slides within the outer body to block the transverse ports when the tool is in the extended position. Also, the tools may be adapted such that no torque is transmitted between the portion of the drill string above the cleaning tool and the portion of the drill string below the tool when the tool is at the collapsed position.

Movement of the known tool between the extended and collapsed positions can be performed in a number of ways. One method is to support a shoulder of the tool on the top of a liner and move the tool to the collapsed position by increasing the load on the top of the tool and compressing a spring.

Therefore, fluid can flow through the transverse ports at this location. Another method is to lift the drill string so that the weight of the drill string below the tool causes the tool to move to the extended position. The tool is moved to the collapsed position by lowering the drill string. Therefore, fluid can flow through the transverse ports when the drill string has been lowered.

It is desirable that the tool can be collapsed without using a portion of the casing or without having to lower the drill string so as to allow flow through the transverse ports at more vertical locations within the borehole and casing.

It is often necessary to operate valves located at a lower end of the drill string. A common method of doing this is to drop balls or darts down the internal bore of the drill string including the cleaning tool to contact and operate the valves. The cleaning tool provided within the drill string should not interfere with this process. However, known tools require step changes in the internal diameter of the through bore of the tools, since components such as the mandrel and outer body must slide relative to each other as the tool moves between the extended and collapsed positions. During normal operation, with the tool at the extended position, there is an internal dimensional step change for fluid flowing through the tool. A dropped ball which deviates from the central region of the bore of the outer body may fail to flow into the mandrel. Also, the non-laminar flow in the region of the step change may alter the flow path of the dropped ball which again may fail to flow into the mandrel. Even without step changes and non-laminar flow, the long run of the ball within a tool (which is rarely substantially vertical) means that the ball seldom remains at the centre of the tool.

Furthermore, a particular problem exists when deviated drilling is performed. In an angled well, the drill string is also at an angled orientation and, due to the effects of gravity, the dropped ball tends to travel to the low side of the tool and so may fail to flow into the mandrel for this reason.

It is desirable to provide means for ensuring that a dropped ball will consistently flow into the mandrel.

SUMMARY

According to a first aspect of the present invention, there is provided a downhole tool for use within a well, comprising: a body having a first downhole fluid passage provided in the body, the first downhole fluid passage having an upper inlet and a lower outlet;

a first sleeve member slidably mounted to the body such that the first sleeve member is movable between a first position in which the first sleeve member extends from the body and a second position in which the first sleeve member is substantially retracted into the first downhole fluid passage of the body; and guide means adapted to guide an object travelling within the first downhole fluid passage to the first sleeve member.

Preferably the body includes at least one secondary fluid passage extending between the first downhole fluid passage and an outer surface of the body.

Preferably the first sleeve member is adapted to close the or each secondary fluid passage when the first sleeve member is at one of the first and second positions. Preferably the first sleeve member is adapted to close the or each secondary fluid passage when the first sleeve member is at the first position.

Preferably the guide means comprises a second sleeve member. Preferably the second sleeve member is coupled to the body. Preferably the second sleeve member is fixed relative to the body. Preferably the second sleeve member extends from the first downhole fluid passage and into the bore of the first sleeve member. Preferably the second sleeve member is movably coupled to the first sleeve member. Preferably the second sleeve member is slidably mounted to the first sleeve member. Preferably the second sleeve member is coaxial with the longitudinal axis of the tool.

Preferably the tool includes retention means adapted to maintain the first sleeve member at one or both of the first and second positions. Preferably the retention means comprises an engaging member for maintaining the first sleeve member at the first position. Preferably the engaging member is adapted to disengage at a predetermined load acting on the body to allow the first sleeve member to move to the second position.

Preferably the tool includes torque transmitting means such that rotation of the body causes rotation of the first sleeve member when the first sleeve member is at one of the first and second positions. Preferably the torque transmitting means is adapted such that rotation of the body causes rotation of the first sleeve member only when the first sleeve member is at the first position.

According to a second aspect of the present invention, there is provided a downhole tool for use within a well, comprising:

a body having a first downhole fluid passage provided in the body, the first downhole fluid passage having an upper inlet and a lower outlet;

a first sleeve member slidably mounted to the body such that the first sleeve member is movable between a first position in which the first sleeve member extends from the body and a second position in which the first sleeve member is substantially retracted into the first downhole fluid passage of the body; and retention means adapted to maintain the first sleeve member at one or both of the first and second positions, wherein the retention means comprises an engaging member for locking the first sleeve member relative to the body when the first sleeve member is at the first position.

Preferably the engaging member is adapted to disengage at a predetermined load acting on the body to allow the first sleeve member to move to the second position.

Preferably the tool includes torque transmitting means such that rotation of the body causes rotation of the first sleeve member when the first sleeve member is at one of the first and second positions. Preferably the torque transmitting means is adapted such that rotation of the body causes rotation of the first sleeve member only when the first sleeve member is at the first position.

Preferably the body includes at least one secondary fluid passage extending between the first downhole fluid passage and an outer surface of the body.

Preferably the first sleeve member is adapted to close the or each secondary fluid passage when the first sleeve member is at one of the first and second positions. Preferably the first sleeve member is adapted to close the or each secondary fluid passage when the first sleeve member is at the first position.

Preferably the tool includes guide means adapted to guide an object travelling within the first downhole fluid passage to the first sleeve member.

Preferably the guide means comprises a second sleeve member. Preferably the second sleeve member is coupled to the body. Preferably the second sleeve member extends from the first downhole fluid passage and into the bore of the first sleeve member.

Preferably the second sleeve member includes a number of apertures or slots to allow fluid to flow from the second sleeve member to the first downhole fluid passage. Preferably the apertures or slots are sized such that the object is prevented from escaping from the second sleeve member via the apertures or slots.

An embodiment of the present invention will now be described, by way of example only, with reference to the accompanying drawings, in which:

DETAILED DESCRIPTION OF DRAWINGS

Figure 1:
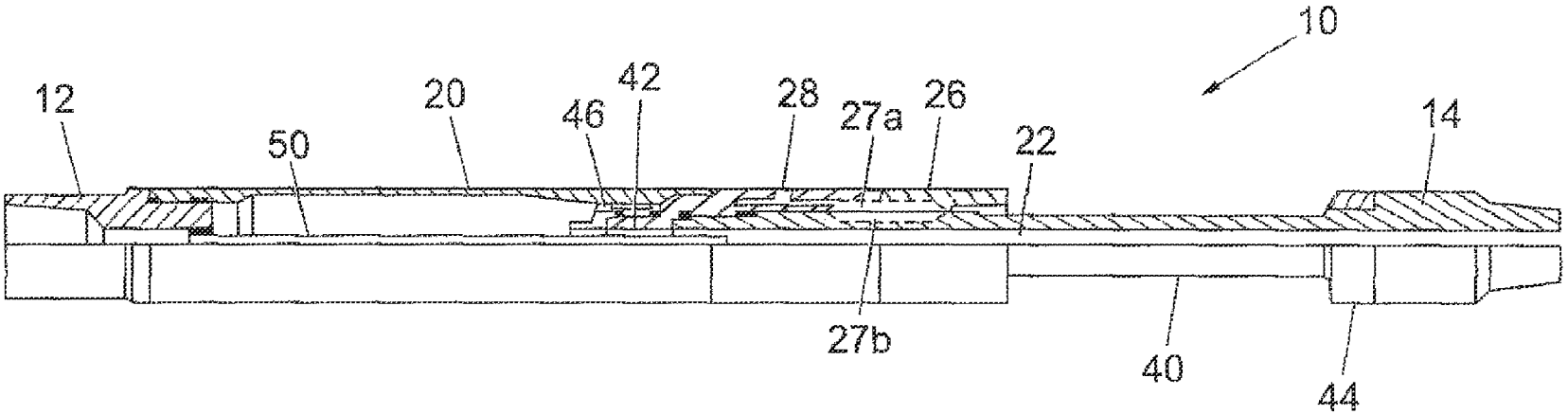
FIG. 1 shows a side view of a downhole tool with the first sleeve member at a first position.
Figure 2:
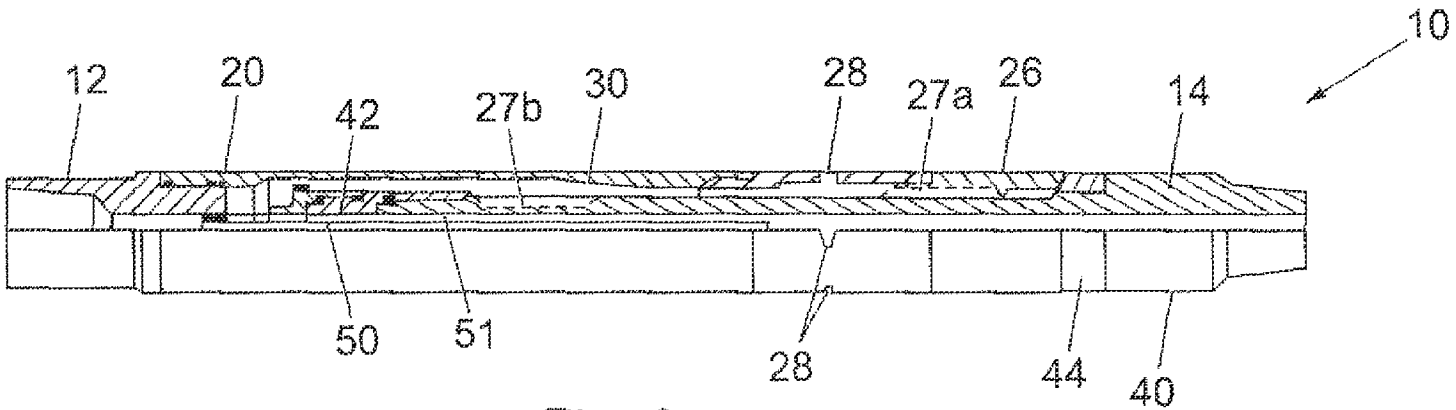
FIG. 2 shows a side view of the tool of FIG. 1 with the first sleeve member at a second position.

FIGS. 1 and 2 show a downhole tool 10 for use within a well. The tool 10 includes an outer body 20 having a first fluid passage 22 which has an upper inlet 24 and a lower outlet 26. A top sub 12 is threadably fastened to the body 20. This defines a first step change in the internal diameter for fluid flowing through the top sub 12 and body 20. The top sub 12 is connectable at an upper end to a drill string (not shown).

A bottom sub 14 includes a first sleeve 40 which is mounted to the body 20. The bottom sub 14 is connectable at a lower end to the drill string. The first sleeve 40 can slide relative to the body 20 between a first position in which the first sleeve 40 extends from the body 20 (shown in FIG. 1) and a second position in which the first sleeve 40 is retracted within the first fluid passage 22 of the body 20 (shown in FIG. 2). This defines a second step change in the internal diameter for fluid flowing from the body 20 to the first sleeve 40. The bottom sub 14 includes a bearing ring 44 to reduce friction between the bottom sub 14 and body 20 when the first sleeve 40 is at the second position.

The body 20 includes a number of secondary fluid passages or transverse ports 28 which extend from the first fluid passage 22 to the outer surface of the body 20. A bypass channel 30 fluidly connects the first fluid passage 22 and transverse ports 28 when the first sleeve 30 is retracted within the first fluid passage 22. However, the first sleeve 40 includes a plug member 42 which tends to block the bypass channel 30, and therefore the transverse ports 28, when the first sleeve 30 is at the extended position. Therefore, the first sleeve 40 is adapted to substantially close each transverse port 28 when the first sleeve 40 is at the first position. Therefore, at this position, all, or at least the majority of, fluid flowing within the tool 10 will flow from the top sub 12 via the upper inlet 24 and the lower outlet 26 to the first sleeve 40.

Figure 3:
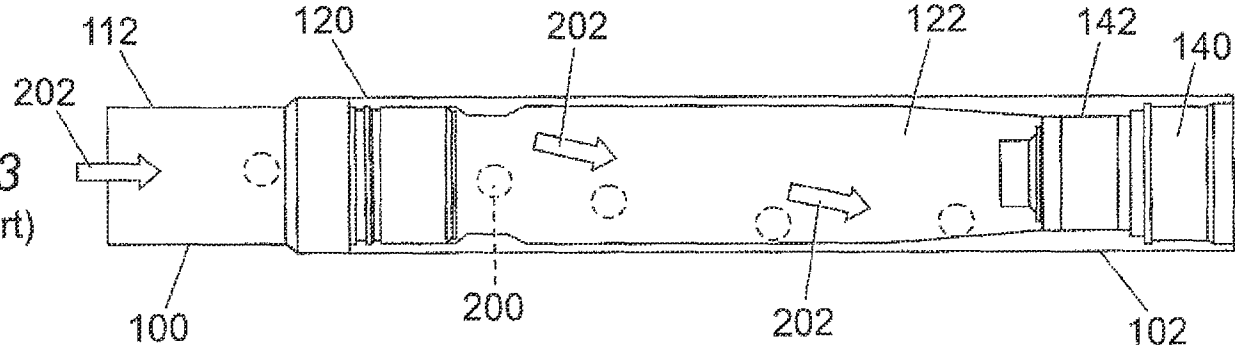
Fig. 3 (Prior Art)
FIG. 3 shows a partial sectional side view of a top portion of a prior art tool with a first sleeve member at a first position.
Figure 4:
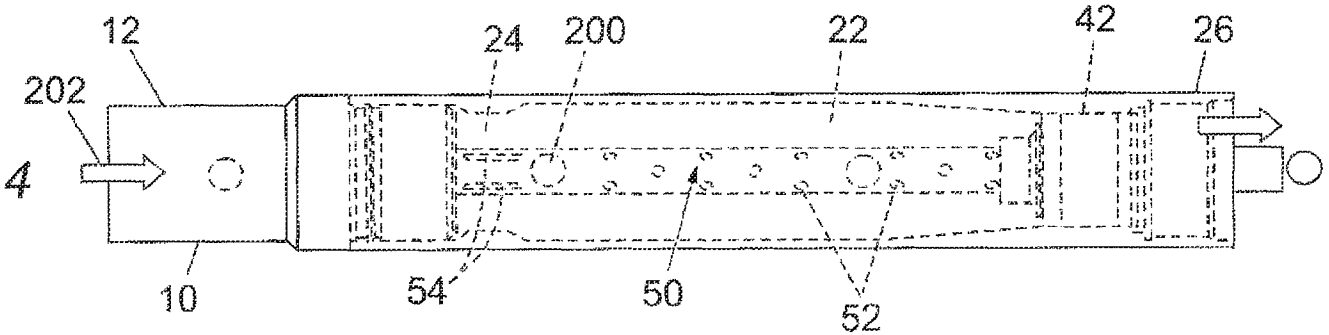
FIG. 4 shows a partial sectional side view of a top portion of the tool of FIG. 1 with the first sleeve member at the first position.
Figure 5:
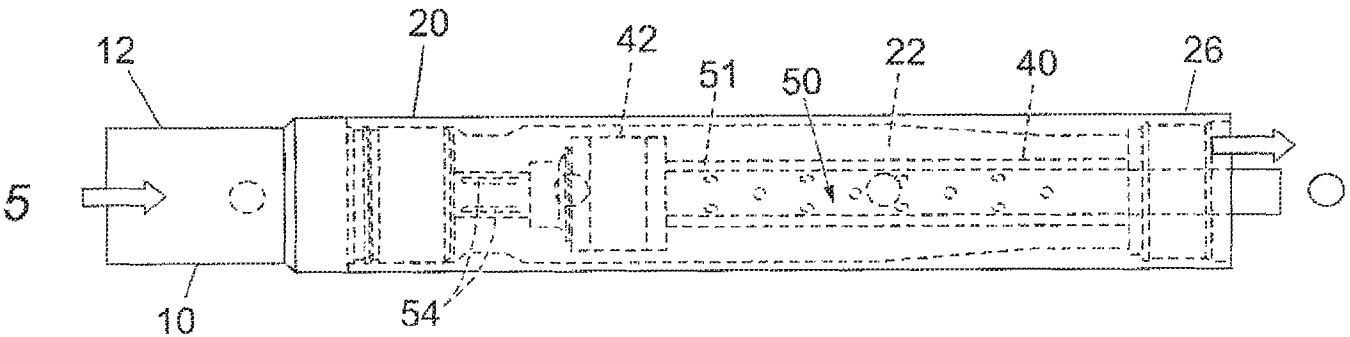
FIG. 5 shows a partial sectional side view of a top portion of the tool of FIG. 1 with the first sleeve member near the second position.

FIG. 3 shows the top portion of a prior art tool 100. The tool 100 is the same as the tool 10 according to the invention except that no guide means or retention means are included (as described below). The tool 100 has a first sleeve 140 which is at a first position.

FIG. 3 also shows a dropped ball 200 at various positions within the tool 100. However, the tool 100 includes a first step change in the internal diameter of the tool 100 where the top sub 112 is connected to the body 120, and a second step change where the body 120 is connected to the first sleeve 140. The flow path 202 of the dropped ball 200 is affected by gravity and also non-laminar flow in the region of these step changes which causes the ball 200 to fail to flow into the mandrel. Also, the tool 100 is within an angled well and gravity causes the ball 200 to travel to the low side 102 of the tool 100.

To overcome this problem, the tool 10 of the invention includes guide means to guide the ball 200 travelling within the first fluid passage 22 to the first sleeve 40.

The guide means comprises a second sleeve 50 which is fixed relative to the top sub 12. Therefore, the second sleeve 50 is coupled to the body 20 via the top sub 12. The second sleeve 50 extends within the first fluid passage 22 and into the bore of the first sleeve 40, even when the first sleeve 40 is at the extended position. Therefore, the second sleeve 50 is slidably mounted to the first sleeve 40. In fact, the second sleeve 50 is loosely slidable on the first sleeve 40 to avoid fouling when the first sleeve 40 slides on the second sleeve 50. This also avoids large changes in flow area which could cause problems such as high back pressure. Fluid is also free to flow via the gap between the outer diameter of the second sleeve 50 and the inner diameter of the first sleeve 40.

The second sleeve 50 includes a number of apertures 52 which allows fluid to flow from the second sleeve 50 into the first fluid passage 22 and this avoids high back pressure and maintains smooth flow. Also, slots 54 are provided in the second sleeve 50 to allow fluid to flow into the second sleeve 50. These slots 54 are at a suitable location in the flow path to the transverse ports 28. It is to be noted that these apertures and slots are suitably sized to allow fluid flow but prevent the escape of the ball 200 from the second sleeve 50.

When a ball 200 is dropped down the drill string and falls through the bore of the top sub 12, the second sleeve 50 guides the ball from this location, through the first fluid passage 22 and into the first sleeve 40. The ball is kept central within the first fluid passage 22. Therefore, step changes in the internal diameter of the tool 100 do not affect the flow path 202 of the ball 200, nor does any angled orientation of the tool 10.

When the first sleeve 40 is moved to the collapsed position, the second sleeve 50 is free to slide within the first sleeve 40.

As shown in FIGS. 1 and 2, the tool 10 includes retention means to maintain the first sleeve 40 at the first position. The retention means comprises an engaging member or shearing ring 46 which engages with the body 20 when the first sleeve 40 is at the first position. The shearing ring 46 is adapted to disengage at a predetermined load applied by the drill string above the tool 10 and acting on the top sub 12, and therefore the body 20.

The tool 10 also includes torque transmitting means so that rotation of the body 20 causes rotation of the first sleeve 40 when the first sleeve 40 is at the first position. The body 20 has an internal hexagonal profile 27*a* at one longitudinal section, which is the lower outlet 26. The first sleeve 40 has a corresponding external hexagonal profile 27*b* at one longitudinal section. When the first sleeve 40 is at the first position, these corresponding hexagonal profiles 27*a*, 27*b* mate to allow coupled rotation. When the first sleeve 40 is at other positions, there is no mating and the body 20 is free to rotate relative to the first sleeve 40.

Various modifications and improvements can be made without departing from the scope of the present invention.

The invention claimed is:

1. A downhole tool for use within a well, comprising:

a body having a first downhole fluid passage provided in the body and at least one secondary fluid passage extending between the first downhole fluid passage and an outer surface of the body, the first downhole fluid passage having an upper inlet and a lower outlet; a first sleeve member slidably mounted to the body such that the first sleeve member is movable between a first position in which the first sleeve member extends from the body and a second position in which the first sleeve member is substantially retracted into the first downhole fluid passage of the body, the first sleeve member being adapted to close the or each secondary fluid passage when the first sleeve member is at one of the first and second positions; and a second sleeve member adapted to guide an object travelling within the first downhole fluid passage to the first sleeve member wherein the second sleeve member comprises at least one aperture defining at least one tertiary flow passage to allow fluid communication between a bore of the second sleeve member and an outer surface of the second sleeve member, such that the at least one tertiary flow passage remains open to allow said fluid communication when the first sleeve is in its first position, and when the first sleeve is in its second position.

2. A downhole tool as claimed in claim 1, wherein the first sleeve member has an upper inlet and wherein the second sleeve member is adapted to guide an object travelling within the first downhole fluid passage to the upper inlet of the first sleeve member.

3. A downhole tool as claimed in claim 1, wherein the second sleeve member is coupled to the body.

4. A downhole tool as claimed in claim 3, wherein the second sleeve member is fixed relative to the body.

5. A downhole tool as claimed in claim 1, wherein the second sleeve member extends from the first downhole fluid passage and into a bore of the first sleeve member.

6. A downhole tool as claimed in claim 1, wherein the second sleeve member is movably coupled to the first sleeve member.

7. A downhole tool as claimed in claim 6, wherein the second sleeve member is slidably mounted to the first sleeve member.

8. A downhole tool as claimed in claim 1, wherein the second sleeve member is coaxial with the longitudinal axis of the tool.

9. A downhole tool as claimed in claim 1, including a retention mechanism adapted to maintain the first sleeve member at one or both of the first and second positions.

10. A downhole tool as claimed in claim 9, wherein the retention mechanism comprises a first engaging member for maintaining the first sleeve member at the first position.

11. A downhole tool as claimed in claim 10, wherein the engaging member is adapted to disengage at a predetermined load acting on the body to allow the first sleeve member to move to the second position.

12. A downhole tool as claimed in claim 1, including a torque transmitting mechanism such that rotation of the body causes rotation of the first sleeve member when the first sleeve member is at one of the first and second positions.

13. A downhole tool as claimed in claim 12, wherein the torque transmitting mechanism is adapted such that rotation of the body causes rotation of the first sleeve member only when the first sleeve member is at the first position.

14. A downhole tool as claimed in claim 1, wherein the second sleeve member comprise a plurality of apertures vertically spaced between the inlet and the outlet, the apertures defining a plurality of tertiary flow passages to allow fluid communication between a bore of the second sleeve member and an outer face of the second sleeve member.

15. A downhole tool as claimed in claim 1, wherein the secondary fluid passage is a channel extending substantially in the axial direction of the downhole tool.

16. A downhole tool for use within a well, comprising a body having a first downhole fluid passage provided in the body and at least one secondary fluid passage extending between the first downhole fluid passage and an outer surface of the body, the first downhole fluid passage having an upper inlet and a lower outlet; a first sleeve member slidably mounted to the body such that the first sleeve member is movable between a first position in which the first sleeve member extends from the body and a second position in which the first sleeve member is substantially retracted into the first downhole fluid passage of the body, and a second sleeve member extending from the first downhole fluid passage into a bore of the first sleeve member and adapted to guide an object travelling within the first downhole fluid passage to the first sleeve member;

wherein the first sleeve member is adapted to close the or each secondary fluid passage when the first sleeve member is at the first position.

17. A downhole tool for use within a well, comprising:

a body having a first downhole fluid passage provided in the body and at least one secondary fluid passage extending between the first downhole fluid passage and an outer surface of the body, the first downhole fluid passage having an upper inlet and a lower outlet; a first sleeve member slidably mounted to the body such that the first sleeve member is movable between a first position in which the first sleeve member extends from the body and a second position in which the first sleeve member is substantially retracted into the first downhole fluid passage of the body, the first sleeve member is adapted to close the or each secondary fluid passage when the first sleeve member is at one of the first and second positions;

wherein a second sleeve member extends from the first downhole fluid passage and into a bore of the first sleeve member such that a portion of the first fluid passage is provided between the second sleeve member and first sleeve when the first sleeve is in the second position.

18. A downhole tool as claimed in claim 17, comprising retention mechanism adapted to maintain the first sleeve member at one or both of the first and second positions, wherein the retention mechanism comprises a first engaging member for locking the first sleeve member relative to the body when the first sleeve member is at the first position, the first engaging member being adapted to disengage at a predetermined load acting on the body to allow the first sleeve member to move to the second position.

19. A downhole tool as claimed in claims 17, including a torque transmitting mechanism such that rotation of the body causes rotation of the first sleeve member when the first sleeve member is at one of the first and second positions.

20. A downhole tool as claimed in claim 19, wherein the torque transmitting mechanism is adapted such that rotation of the body causes rotation of the first sleeve member only when the first sleeve member is at the first position.

21. A downhole tool as claimed in claim 17, including a second sleeve member adapted to guide an object travelling within the first downhole fluid passage to the first sleeve member.

22. A downhole tool as claimed in claim 21, wherein the second sleeve member comprises a second sleeve member which is coupled to the body and which extends from the first downhole fluid passage and into the bore of the first sleeve member.

23. A downhole tool as claimed in claim 22, wherein the second sleeve member includes a number of apertures or slots.

24. A downhole tool as claimed in claim 23, wherein the apertures or slots are sized such that the object is prevented from escaping from the second sleeve member via the apertures or slots.

* * * * *